US006623796B1

(12) United States Patent
Van Steenkiste

(10) Patent No.: US 6,623,796 B1
(45) Date of Patent: Sep. 23, 2003

(54) METHOD OF PRODUCING A COATING USING A KINETIC SPRAY PROCESS WITH LARGE PARTICLES AND NOZZLES FOR THE SAME

(75) Inventor: Thomas Hubert Van Steenkiste, Ray, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/117,704

(22) Filed: Apr. 5, 2002

(51) Int. Cl.[7] ..... B05D 1/06

(52) U.S. Cl. ..... 427/189; 427/190; 427/191; 427/195

(58) Field of Search ..... 427/189, 190, 427/191, 192, 195, 458–486; 239/427, 427.3; 134/7

(56) References Cited

U.S. PATENT DOCUMENTS

| | | | | |
|---|---|---|---|---|
| 3,100,724 | A | | 8/1963 | Rocheville |
| 3,993,411 | A | | 11/1976 | Babcock et al. |
| 4,263,335 | A | | 4/1981 | Wagner et al. |
| 4,416,421 | A | * | 11/1983 | Browning |
| 4,606,495 | A | | 8/1986 | Stewart, Jr. et al. |
| 4,891,275 | A | | 1/1990 | Knoll |
| 4,939,022 | A | | 7/1990 | Palanisamy |
| 5,187,021 | A | | 2/1993 | Vydra et al. |
| 5,271,965 | A | | 12/1993 | Browning |
| 5,302,414 | A | * | 4/1994 | Alkhimov et al. |
| 5,308,463 | A | | 5/1994 | Hoffmann et al. |
| 5,340,015 | A | | 8/1994 | Hira et al. |
| 5,395,679 | A | | 3/1995 | Myers et al. |
| 5,424,101 | A | | 6/1995 | Atkins et al. |
| 5,464,146 | A | | 11/1995 | Zalvzec et al. |
| 5,476,725 | A | | 12/1995 | Papich et al. |
| 5,527,627 | A | | 6/1996 | Lautzenhiser et al. |
| 5,593,740 | A | | 1/1997 | Strumbon et al. |
| 5,648,123 | A | | 7/1997 | Kuhn et al. |
| 5,965,193 | A | | 10/1999 | Ning et al. |
| 5,975,996 | A | * | 11/1999 | Settles |
| 6,033,622 | A | | 3/2000 | Maruyama |
| 6,074,737 | A | | 6/2000 | Jordan et al. |
| 6,129,948 | A | | 10/2000 | Plummet et al. |
| 6,139,913 | A | | 10/2000 | Van Steenkiste et al. |
| 6,283,386 | B1 | | 9/2001 | Van Steenkiste et al. |

OTHER PUBLICATIONS

Van Steenkiste, et al; *Kinetic Spray Coatings*; in Surface & Coatings Technology III; 1999; pp. 62–71.

(List continued on next page.)

*Primary Examiner*—Fred J. Parker
(74) *Attorney, Agent, or Firm*—Scott A. McBain

(57) ABSTRACT

A method of depositing large particles having an average nominal diameter of greater than 106 microns up to 250 microns onto substrates using a kinetic spray system is disclosed. The method utilizes a powder injector tube having a reduced inner diameter and a de Laval type nozzle having an elongated throat to exit end length. The method permits deposition of much larger particles than previously possible.

20 Claims, 2 Drawing Sheets

OTHER PUBLICATIONS

Liu, et al; *Recent Development in the Fabrication of Metal Matrix–Particulate Composites Using Powder Metallurgy Techniques*; in Journal of Material Science 29; 1994; pp. 1999–2007; National University of Singapore, Japan.
Papyrin; *The Cold Gas–Dynamic Spraying Method a New Method for Coatings Deposition Promises a New Generation of Technologies; Novosibirsk, Russia*. No date.
McCune, al; Characterization of Copper and Steel Coatings Made by the Cold Gas–Dynamic Spray Method; National Thermal Spray Conference. No date.
Alkhimov, et al; *A Method of "Cold" Gas–Dynamic Deposition; Sov. Phys. Kokl. 36( Dec. 12, 1990; pp. 1047–1049*.
Dykuizen, et al; *Impact of High Velocity Cold Spray Particles*; in Journal of Thermal Spray Technology 8(4); 1999; pp. 559–564.
Swartz, et al; *Thermal Resistance At Interfaces; Appl. Phys. Lett., vol. 51, No. 26, Dec. 28, 1987; pp. 2201–2202*.
Davis, et al; *Thermal Conductivity of Metal–Matrix Composlites; J.Appl. Phys. 77 (10), May 15, 1995; pp. 4494–4960*.
Stoner et al; *Measurements of the Kapitza Conductance between Diamond and Several Metals*; Physical Review Letters, vol. 68, No. 10; Mar. 9, 1992; pp. 1563–1566.
Stoner et al; *Kapitza conductance and heat flow between solids at temperatures from 50 to 300K*; Physical Review B, vol. 48, No. 22, Dec. 1, 1993–II; pp. 16374;16387.
Johnson et al; *Diamond/Al metal matrix composites formed by the pressureless metal infiltration process*; J. Mater,Res., vol. 8, No. 5, May 1993; pp. 11691173.
Rajan et al; *Reinforcement coatings and interfaces in Aluminium Metal Matrix Composites*; pp. 3491–3503. 1998.
*LEC Manufacturing and Engineering Capabilities*; Lanxide Electronic Components, Inc. No date.
Dykhuizen et al; *Gas Dynamic of Cold Spray*; Journal of Thermal Spray Technology; Jun. 1998; pp. 205–212.
McCune et al; *An Exploration of the Cold Gas–Dynamic Spray Method For Several Materials Systems*; No date.
Ibrahim et al; *Particulate Reinforced Metal Matrix Composites—A Review; Journal of Matrials Science 26*; pp. 1137–1156. No date.

* cited by examiner

METHOD OF PRODUCING A COATING USING A KINETIC SPRAY PROCESS WITH LARGE PARTICLES AND NOZZLES FOR THE SAME

INCORPORATION BY REFERENCE

U.S. Pat. No. 6,139,913, "Kinetic Spray Coating Method and Apparatus," and U.S. Pat. No. 6,283,386 "Kinetic Spray Coating Apparatus" are incorporated by reference herein.

TECHNICAL FIELD

The present invention is directed to a method for producing a coating using a kinetic spray system with much larger particles than previously used. The invention further includes a kinetic spray nozzle for use with the larger particles. The invention permits one to increase the particle size used in the system up to at least 250 microns, thereby increasing the range of useful particles and decreasing the processing difficulties associated with the smaller particles typically used.

BACKGROUND OF THE INVENTION

A new technique for producing coatings on a wide variety of substrate surfaces by kinetic spray, or cold gas dynamic spray, was recently reported in an article by T. H. Van Steenkiste et al., entitled "Kinetic Spray Coatings," published in Surface and Coatings Technology, vol. 111, pages 62–71, Jan. 10, 1999. The article discusses producing continuous layer coatings having low porosity, high adhesion, low oxide content and low thermal stress. The article describes coatings being produced by entraining metal powders in an accelerated air stream, through a converging-diverging de Laval type nozzle and projecting them against a target substrate. The particles are accelerated in the high velocity air stream by the drag effect. The air used can be any of a variety of gases including air or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must be high enough to exceed the yield stress of the particle to permit it to adhere when it strikes the substrate. It was found that the deposition efficiency of a given particle mixture was increased as the inlet air temperature was increased. Increasing the inlet air temperature decreases its density and increases its velocity. The velocity varies approximately as the square root of the inlet air temperature. The actual mechanism of bonding of the particles to the substrate surface is not fully known at this time. It is believed that the particles must exceed a critical velocity prior to their being able to bond to the substrate. The critical velocity is dependent on the material of the particle. It is believed that the initial particles to adhere to a substrate have broken the oxide shell on the substrate material permitting subsequent metal to metal bond formation between plastically deformed particles and the substrate. Once an initial layer of particles has been formed on a substrate subsequent particles bind not only to the voids between previous particles bound to the substrate but also engage in particle to particle bonds. The bonding process is not due to melting of the particles in the air stream because the temperature of the air stream is always below the melting temperature of the particles and the temperature of the particles is always below that of the air stream.

This work improved upon earlier work by Alkimov et al. as disclosed in U.S. Pat. No. 5,302,414, issued Apr. 12, 1994. Alkimov et al. disclosed producing dense continuous layer coatings with powder particles having a particle size of from 1 to 50 microns using a supersonic spray.

The Van Steenkiste article reported on work conducted by the National Center for Manufacturing Sciences (NCMS) to improve on the earlier Alkimov process and apparatus. Van Steenkiste et al. demonstrated that Alkimov's apparatus and process could be modified to produce kinetic spray coatings using particle sizes of greater than 50 microns and up to about 106 microns.

This modified process and apparatus for producing such larger particle size kinetic spray continuous layer coatings are disclosed in U.S. Pat. Nos. 6,139,913, and 6,283,386. The process and apparatus provide for heating a high pressure air flow up to about 650° C. and combining this with a flow of particles. The heated air and particles are directed through a de Laval-type nozzle to produce a particle exit velocity of between about 300 m/s (meters per second) to about 1000 m/s. The thus accelerated particles are directed toward and impact upon a target substrate with sufficient kinetic energy to impinge the particles to the surface of the substrate. The temperatures and pressures used are sufficiently lower than that necessary to cause particle melting or thermal softening of the selected particle. Therefore, no phase transition occurs in the particles prior to impingement. It has been found that each type of particle material has a threshold critical velocity that must be exceeded before the material begins to adhere to the substrate. The disclosed method did not disclose the use of particles in excess of 106 microns.

One difficulty associated with all of these prior art kinetic spray systems arises from the small size of the particles that are used. The largest particles are 106 microns, and more typically the particles range from 10 to 50 microns. Because of their large surface to volume ratio these particles tend to have a higher level of oxide formation which is detrimental to the process. It is also difficult to handle these small particles in the feed systems, because they tend to clog the systems. Thus it would be very beneficial to develop a process that could use larger particles to reduce these problems.

SUMMARY OF THE INVENTION

In a first embodiment the present invention is a method of kinetic spray coating a substrate comprising the steps of: providing particles having an average nominal diameter equal to or less than 250 microns; entraining the particles into a flow of a gas, the gas at a temperature below a melt temperature of the particles; and directing the particles entrained in the flow of gas through a supersonic nozzle having a length from a throat to an exit end of from 200 to 400 millimeters thereby accelerating the particles to a velocity sufficient to result in adherence of the particles on a substrate positioned opposite the nozzle.

In a second embodiment the present invention is a method of kinetic spray coating a substrate comprising the steps of: providing particles having an average nominal diameter equal to or less than 250 microns; passing the particles through a powder injector tube having an inner diameter equal to or less than 0.90 millimeters and into a flow of a gas; entraining the particles into the flow of the gas, the gas at a temperature below a melt temperature of the particles; and directing the particles entrained in the flow of gas through a supersonic nozzle having a length from a throat to an exit end of from 200 to 400 millimeters thereby accelerating the particles to a velocity sufficient to result in adherence of the particles on a substrate positioned opposite the nozzle.

DESCRIPTION OF THE PREFERRED EMBODIMENT

The present invention comprises an improvement to the kinetic spray process as generally described in U.S. Pat. Nos. 6,139,913, 6,283,386 and the article by Van Steenkiste, et al. entitled "Kinetic Spray Coatings" published in Surface and Coatings Technology Volume III, Pages 62–72, Jan. 10, 1999, all of which are herein incorporated by reference.

Figure 1:
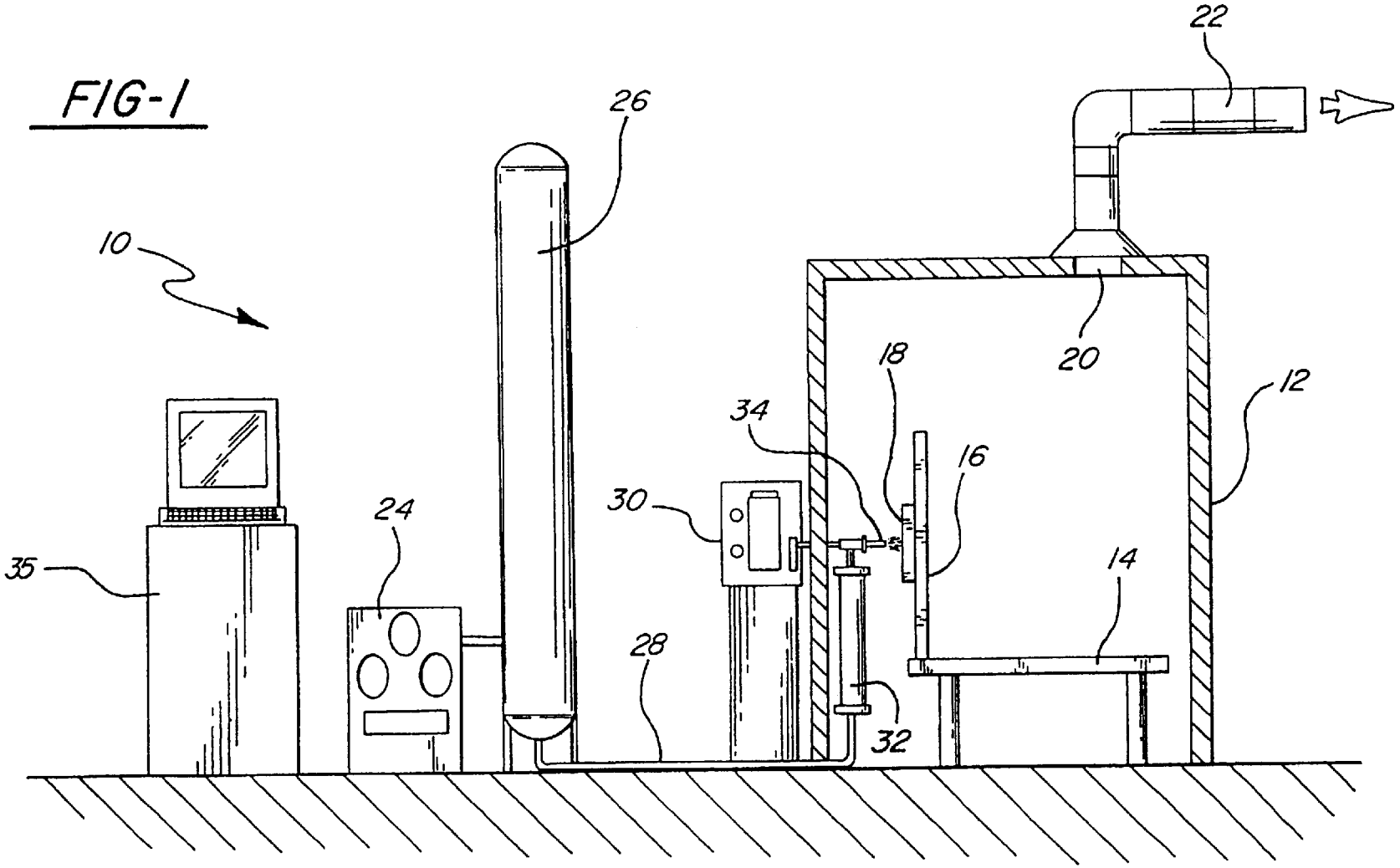
FIG. 1 is a generally schematic layout illustrating a kinetic spray system for performing the method of the present invention.

Referring first to FIG. 1, a kinetic spray system according to the present invention is generally shown at 10. System 10 includes an enclosure 12 in which a support table 14 or other support means is located. A mounting panel 16 fixed to the table 14 supports a work holder 18 capable of movement in three dimensions and able to support a suitable workpiece formed of a substrate material to be coated. The enclosure 12 includes surrounding walls having at least one air inlet, not shown, and an air outlet 20 connected by a suitable exhaust conduit 22 to a dust collector, not shown. During coating operations, the dust collector continually draws air from the enclosure 12 and collects any dust or particles contained in the exhaust air for subsequent disposal.

The spray system 10 further includes an air compressor 24 capable of supplying air pressure up to 3.4 MPa (500 psi) to a high pressure air ballast tank 26. The air ballast tank 26 is connected through a line 28 to both a high pressure powder feeder 30 and a separate air heater 32. The air heater 32 supplies high pressure heated air, the main gas described below, to a kinetic spray nozzle 34. The powder feeder 30 mixes particles of a spray powder with unheated high pressure air and supplies the mixture to a supplemental inlet line 48 of the nozzle 34. A computer control 35 operates to control both the pressure of air supplied to the air heater 32 and the temperature of the heated main gas exiting the air heater 32.

Figure 2:
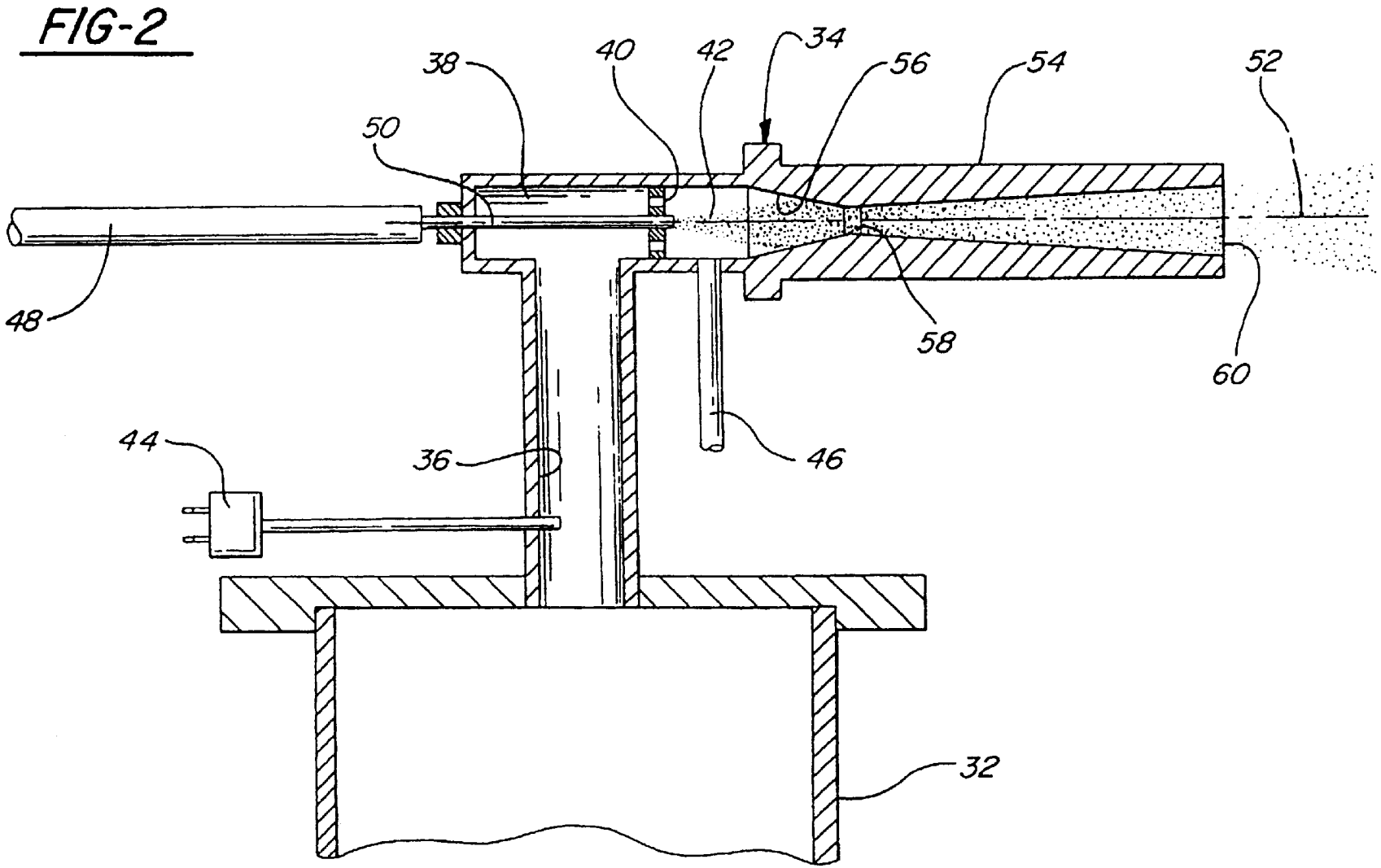
FIG. 2 is an enlarged cross-sectional view of a kinetic spray nozzle used in the system.

FIG. 2 is a cross-sectional view of the nozzle 34 and its connections to the air heater 32 and the supplemental inlet line 48. A main air passage 36 connects the air heater 32 to the nozzle 34. Passage 36 connects with a premix chamber 38 which directs air through a flow straightener 40 and into a mixing chamber 42. Temperature and pressure of the air or other heated main gas are monitored by a gas inlet temperature thermocouple 44 in the passage 36 and a pressure sensor 46 connected to the mixing chamber 42.

The mixture of unheated high pressure air and coating powder is fed through the supplemental inlet line 48 to a powder injector tube 50 comprising a straight pipe having a predetermined inner diameter. The tube 50 has a central axis 52 which is preferentially the same as the axis of the premix chamber 38. The tube 50 extends through the premix chamber 38 and the flow straightener 40 into the mixing chamber 42.

Mixing chamber 42 is in communication with the de Laval type nozzle 54. The nozzle 54 has an entrance cone 56 that decreases in diameter to a throat 58. Downstream of the throat is an exit end 60. The largest diameter of the entrance cone 56 may range from 10 to 6 millimeters, with 7.5 millimeters being preferred. The entrance cone 56 narrows to the throat 58. The throat 58 may have a diameter of from 3.5 to 1.5 millimeters, with from 3 to 2 millimeters being preferred. The portion of the nozzle 54 from downstream of the throat 58 to the exit end 60 may have a variety of shapes, but in a preferred embodiment it has a rectangular cross-sectional shape. At the exit end 60 the nozzle 54 preferably has a rectangular shape with a long dimension of from 8 to 14 millimeters by a short dimension of from 2 to 6 millimeters.

As disclosed in U.S. Pat. Nos. 6,139,913 and 6,283,386 the powder injector tube 50 supplies a particle powder mixture to the system 10 under a pressure in excess of the pressure of the heated main gas from the passage 36. The nozzle 54 produces an exit velocity of the entrained particles of from 300 meters per second to as high as 1200 meters per second. The entrained particles gain kinetic and thermal energy during their flow through this nozzle. It will be recognized by those of skill in the art that the temperature of the particles in the gas stream will vary depending on the particle size and the main gas temperature. The main gas temperature is defined as the temperature of heated high-pressure gas at the inlet to the nozzle 54. Since these temperatures are substantially less than the melting point of the particles, even upon impact, there is no change in the solid phase of the original particles due to transfer of kinetic and thermal energy, and therefore no change in their original physical properties. The particles are always at a temperature below the main gas temperature. The particles exiting the nozzle 54 are directed toward a surface of a substrate to coat it.

Upon striking a substrate opposite the nozzle 54 the particles flatten into a nub-like structure with an aspect ratio of generally about 5 to 1. When the substrate is a metal and the particles are a metal the particles striking the substrate surface fracture the oxidation on the surface layer and subsequently form a direct metal-to-metal bond between the metal particle and the metal substrate. Upon impact the kinetic sprayed particles transfer substantially all of their kinetic and thermal energy to the substrate surface and stick if their yield stress has been exceeded. As discussed above, for a given particle to adhere to a substrate it is necessary that it reach or exceed its critical velocity which is defined as the velocity where at it will adhere to a substrate when it strikes the substrate after exiting the nozzle. This critical velocity is dependent on the material composition of the particle. In general, harder materials must achieve a higher critical velocity before they adhere to a given substrate. It is not known at this time exactly what is the nature of the particle to substrate bond; however, it is believed that a portion of the bond is due to the particles plastically deforming upon striking the substrate.

As disclosed in U.S. Pat. No. 6,139,913 the substrate material may be comprised of any of a wide variety of materials including a metal, an alloy, a semi-conductor, a ceramic, a plastic, and mixtures of these materials. All of these substrates can be coated by the process of the present invention. The particles used in the present invention may comprise any of the materials disclosed in U.S. Pat. Nos. 6,139,913 and 6,283,386 in addition to other know particles. These particles generally comprise metals, alloys, ceramics, polymers, diamonds and mixtures of these.

As discussed above, present kinetic spray systems generally utilize particles of 106 microns or less. Larger particles do not adhere to the substrates in current systems. The present invention discloses a method for using much larger particles than previous systems. In fact, the present invention discloses use of particle in the range of up to 250 microns. This is accomplished by making two modifications to present kinetic spray systems.

First, the inner diameter of the powder injector tube 50, which directs the powder into the de Laval nozzle 54, is reduced to a size of from 0.90 millimeter to 0.40 millimeter. This is in contrast to a typical system wherein the powder injector tube generally has an inner diameter of approximately 2.45 millimeters or larger. This is believed to provide two important benefits that allow for spraying of larger particles. The smaller diameter reduces the amount of unheated air that is combined with the heated main gas in the mixing chamber 42 and thereby leads to a smaller reduction in the main gas temperature. The higher the main gas temperature the faster a given particle is accelerated over a given distance. In addition, the smaller the inner diameter of the injector tube 50 the less turbulence it introduces in the flow of the gas through the nozzle 54. Turbulence is detrimental to acceleration of particles in the nozzle 54. As a theoretical limit the size of the inner diameter of the injector tube 50 can be reduced down to the size of the particles one is injecting, however, in general it is preferably from 0.90 to 0.40 millimeters in diameter.

Second, the length of the nozzle 54 from the throat 58 to the exit end 60 is greatly increased. In a typical system the length of the nozzle 54 from the throat 58 to the exit end 60 is from 60 to 80 millimeters. In the present invention the length has been increased to from 200 to 400 millimeters. This increase in length in combination with the smaller injector tube 50 inner diameter allows one to spray particles up to 250 microns in diameter. The longer nozzle 54 allows one to keep the main gas temperature below the melting temperature of many useful materials and to use very large particles of these materials. In general, the present invention extends the size of usable powders to ones up to 250 microns in diameter. The longer length enables the main gas to accelerate the larger particles to velocities upon exit of from 300 to 1200 m/s.

EXAMPLE 1

In a first example the system 10 was use to spray copper particles having an average nominal diameter of 250 microns onto an aluminum substrate. The substrate was not sandblasted prior to attempts to coat it. Using a nozzle 54 having a length of 80 millimeters from throat 58 to exit end 60, a throat 58 of 2 millimeters, and an injector tube 50 inner diameter of 0.89, the particles could not be adhered to the substrate. When the system 10 was changed to a nozzle 54 having a length of 300 millimeters from the 2 millimeter throat 58 to the exit end 60 the particles adhered very well to the substrate. The nozzle 54 had a rectangular cross-sectional area beyond the throat 58 and an exit size of 5 by 12.5 millimeters. In both experiments the main gas temperature was set at 1200° F. and its pressure was 300 psi. The powder feed parameters were: 70° F., 350 psi and 500 rpm on the feeder.

While the preferred embodiment of the present invention has been described so as to enable one skilled in the art to practice the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

What is claimed is:

1. A method of kinetic spray coating a substrate comprising the steps of:

a) providing particles having an average nominal diameter of greater than 106 to 250 microns;

b) entraining the particles into a flow of a gas, the gas at a temperature below a melt temperature of the particles; and c) directing the particles entrained in the flow of gas through a supersonic nozzle having a length from a throat to an exit end of from 200 to 400 millimeters, thereby accelerating the particles to a velocity sufficient to result in adherence of the particles on a substrate positioned opposite the nozzle.

2. The method of claim 1, wherein step a) comprises providing particles having an average nominal diameter of from 125 to 250 microns.

3. The method of claim 1, wherein step a) comprises providing particles comprising at least one of a metal, an alloy, a polymer, a ceramic, a diamond, or mixtures thereof.

4. The method of claim 1, wherein step b) further comprises setting the gas at a temperature of from 300 to 3000° F.

5. The method of claim 4, wherein the gas is set at a temperature of from 300 to 1500° F.

6. The method of claim 1, further comprising directing the particles entrained in the flow of gas through a supersonic nozzle having a throat diameter of from 3.5 to 1.5 millimeters.

7. The method of claim 1, further comprising directing the particles entrained in the flow of gas through a supersonic nozzle having a throat diameter of from 3.0 to 2.0 millimeters.

8. The method of claim 1, wherein step c) comprises directing the particles entrained in the flow of gas through a supersonic nozzle having a length from the throat to the exit end of from 250 to 350 millimeters.

9. The method of claim 1, further comprising the step of directing the particles of step a) through an injector tube having an inner diameter of from 0.40 to 0.90 millimeters and then entraining the particles into the flow of gas in step b).

10. The method of claim 1, wherein step c) further comprises positioning a substrate comprising at least one of a metal, an alloy, a ceramic, a plastic, or a mixture thereof opposite the nozzle.

11. A method of kinetic spray coating a substrate comprising the steps of:

a) providing particles having an average nominal diameter equal of greater than 106 to 250 microns;

b) passing the particles through a powder injector tube having an inner diameter equal to or less than 0.90 millimeters and into a flow of a gas;

c) entraining the particles into the flow of the gas, the gas at a temperature below a melt temperature of the particles; and d) directing the particles entrained in the flow of gas through a supersonic nozzle having a length from a throat to an exit end of from 200 to 400 millimeters thereby accelerating the particles to a velocity sufficient to result in adherence of the particles on a substrate positioned opposite the nozzle.

12. The method of claim 11, wherein step a) comprises providing particles having an average nominal diameter of from 125 to 250 microns.

13. The method of claim 11, wherein step a) comprises providing particles comprising at least one of a metal, an alloy, a polymer, a ceramic, a diamond, or mixtures thereof.

14. The method of claim 11, wherein step b) further comprises setting the gas at a temperature of from 300 to 3000° F.

15. The method of claim 14, wherein the gas is set at a temperature of from 300 to 1500° F.

16. The method of claim 11, further comprising directing the particles entrained in the flow of gas through a supersonic nozzle having a throat diameter of from 3.5 to 1.5 millimeters.

17. The method of claim 11, further comprising directing the particles entrained in the flow of gas through a supersonic nozzle having a throat diameter of from 3.0 to 2.0 millimeters.

18. The method of claim 11, wherein step d) comprises directing the particles entrained in the flow of gas through a supersonic nozzle having a length from the throat to the exit end of from 250 to 350 millimeters.

19. The method of claim 11, wherein step b) comprises passing the particles of step a) through a powder injector tube having an inner diameter of from 0.40 to 0.90 millimeters.

20. The method of claim 11, wherein step d) further comprises positioning a substrate comprising at least one of a metal, an alloy, a ceramic, a plastic, or a mixture thereof opposite the nozzle.

* * * * *